United States Patent [19]

Yorio et al.

[11] 4,162,623

[45] Jul. 31, 1979

[54] KEY AND LOCK SYSTEM

[76] Inventors: Noelle Yorio; Albert E. Yorio, both of 70 W. St., Harrison, N.Y. 10582

[21] Appl. No.: 833,447

[22] Filed: Sep. 15, 1977

Related U.S. Application Data

[63] Continuation-in-part of Ser. No. 780,662, Jun. 8, 1977.

[51] Int. Cl.[2] ..... E05B 19/06; E05B 27/04

[52] U.S. Cl. ..... 70/364 A; 70/406; 70/409

[58] Field of Search ..... 70/337, 340, 364 R, 70/364 A, 395, 401, 406, 409

[56] References Cited

U.S. PATENT DOCUMENTS 1,438,336 12/1922 Schroeder ..... 70/364 A

*Primary Examiner*—Robert L. Wolfe

*Attorney, Agent, or Firm*—Brumbaugh, Graves, Donohue & Raymond

[57] ABSTRACT

A lock system comprising (1) a first standard size pin tumbler lock mechanism, such as is used, for example, in an exterior apartment door; (2) a second pin-tumbler lock mechanism substantially smaller in size than the first lock, such as is used for securing an apartment house mailbox; and (3) a key having conventional handle and shank portions and a set of notches and projections extending along one longitudinal edge of the shank portion such that the key, when inserted into the barrel of the standard lock mechanism, will render it operable, and such that the key, when inserted into the barrel of the smaller lock mechanism, will also render it operable.

11 Claims, 5 Drawing Figures

KEY AND LOCK SYSTEM

BACKGROUND OF THE INVENTION

The present application is a continuation-in-part of copending application Ser. No. 780,662, filed June 8, 1977.

This invention relates to an improved key and lock system whereby a single key is capable of operating two dissimilar lock mechanisms. The single key according to the invention has conventional handle and shank portions and is so designed such that a set of notches and projections extending partially along one longitudinal edge of the key shank may be used to operate a standard size lock and a second smaller lock having a shorter barrel. The lock and key system according to the invention has particular applicability in multiple dwelling arrangements where a single key for the main exterior access door and for the mailbox unit affords a great convenience.

Normally, in a multiple dwelling apartment or condominium complex, each housing unit requires a standard size pin-tumbler lock mechanism for securing the main exterior door of the unit. In addition, each housing unit is provided with a mail receptacle having a lock which is normally substantially smaller in size than the standard size exterior door lock. Moreover, the size of the rotating cylinder plug and internal tumblers for the mail receptacle and exterior door locks will differ substantially, and the relative number of tumblers in the locks may vary as well. The smaller size of the mail receptacle lock is necessitated by the physical size of the mailbox itself, while the number of internal tumblers is specified in the present United States Postal Service regulations, which require that the lock be a 5 pin-tumbler type lock (see United States Postal Service, Regulations and Manufacturing Standards, Apartment House Mail Receptacles, Publication No. 17, July 1974, effective May 1, 1975).

As a result of the necessity to use substantially different locks, apartment dwellers and condominium owners have found it necessary to carry two separate keys to permit access to their apartments and mailboxes, which has been found to be in some cases a substantial inconvenience.

Various arrangements have been proposed in the past for operating more than one lock with a single key. The most well-known is the so-called "master key" device. In such a device, a lock is operable by either of two separate key configurations. A series of basically similar locks in size and tumbler number may be so designed and constructed that one of the key configurations is common to all of the locks (the master key arrangement), and the other configuration varies with each lock. A typical "master key" arrangement is shown in U.S. Pat. No. 2,039,126 to Svoboda.

Another arrangement permitting the use of one key in more than one lock configuration is disclosed in U.S. Pat. No. 1,438,336 to Schroeder. A flat key is provided with two sets of notches and projections along its two longitudinal edges. The first set of notches and projections actuates the tumbler in a first lock mechanism and thus renders the lock operable. When the key is inserted upside down into a second lock mechanism having a similar lock barrel, it actuates the tumblers in the second lock so as to render that lock operable as well.

Although the aforementioned devices disclose lock systems where one key operates two locks, in each case the two locks are substantially similar. In the master key arrangement, the portion of the lock which the master key operates is in fact identical in each lock. In the device shown in the Schroeder U.S. Pat. No. 1,438,336, each lock must have substantially the same barrel and thereby differ only in the setting (length) of the tumblers. Neither configuration permits the use of two substantially different size lock mechanisms with a single key.

In our copending U.S. Application Ser. No. 780,662, as in the present application, a key and lock system is also disclosed in which a single key operates two dissimilar and different size lock mechanisms, such as a standard size apartment lock which is secured in the exterior door of a housing unit and a smaller mailbox lock attached to the door of the mailbox assigned to the same housing unit. In that arrangement, however, a key is provided with a first set of notches and projections along one longitudinal edge of the shank portion, and a second set of notches and projections extending partially along the opposite longitudinal edge of the key from the outer extremity of the shank. A standard size lock mechanism is provided having a key slot and barrel which will permit insertion of the key therein, and has a tumbler configuration which will engage the first set of notches and projections to render the lock operable. The smaller lock mechanism also has a key slot and barrel which will permit insertion of the key therein, and has a tumbler configuration which will engage the second set of notches and projections to render that lock operable.

SUMMARY OF THE INVENTION

This invention is a variation of the key and lock system disclosed in Application Ser. No. 780,662, and provides another key-lock arrangement whereby a key and two different size lock mechanisms are formed in a manner whereby the key slot and barrel of either lock will accept the one key, and wherein the tumblers are so arranged that the one key, when inserted in either of the locks, will engage the tumblers thereof to render the lock operable. More specifically, this invention provides (a) a first pin-tumbler lock mechanism having a key slot and barrel, and tumbler pins projecting into the barrel for operating the lock mechanism; (b) a second pin-tumbler lock mechanism, substantially smaller in size than the first, having a somewhat shorter key slot and barrel, and tumbler pins projecting into the barrel for operation of the second lock mechanism is substantially the same manner as the first; and (c) a key having a conventional handle portion and shank portion with a set of notches and projections extending along one longitudinal edge of the shank which when inserted into the key slot and barrel of the first pin-tumbler type lock will engage the tumbler pins thereof so as to render the lock operable, and which when inserted into the key slot and barrel of the second smaller pin-tumbler type lock will likewise engage the pins thereof to render the smaller lock operable, the key slots and barrels of the first and second lock mechanisms formed to accept substantially the entire shank, and a portion of the shank, respectively, of the key.

In the preferred embodiment, both locks have key holes formed to accept a standard size key having a set of notches and projections extending partially along one longitudinal edge. The smaller lock is formed having a barrel such that when the key is inserted the notches and projections extend into the barrel and engage the lock tumblers to render the lock operable. The standard size lock is formed with an internal tumbler configuration identical in number and spacing with that of the smaller lock, and disposed within the lock barrel such that when the key is inserted, the notches and projections will engage the tumblers to render the lock operable. Optionally, the standard size lock may be provided with a number of additional tumblers disposed within the barrel which engage additional notches and projections formed on the key.

BRIEF DESCRIPTION OF THE DRAWINGS

For the purpose of illustrating the invention, reference is made to the accompanying drawings, in which.

DESCRIPTION OF THE PREFERRED EMBODIMENTS

Figure 2:
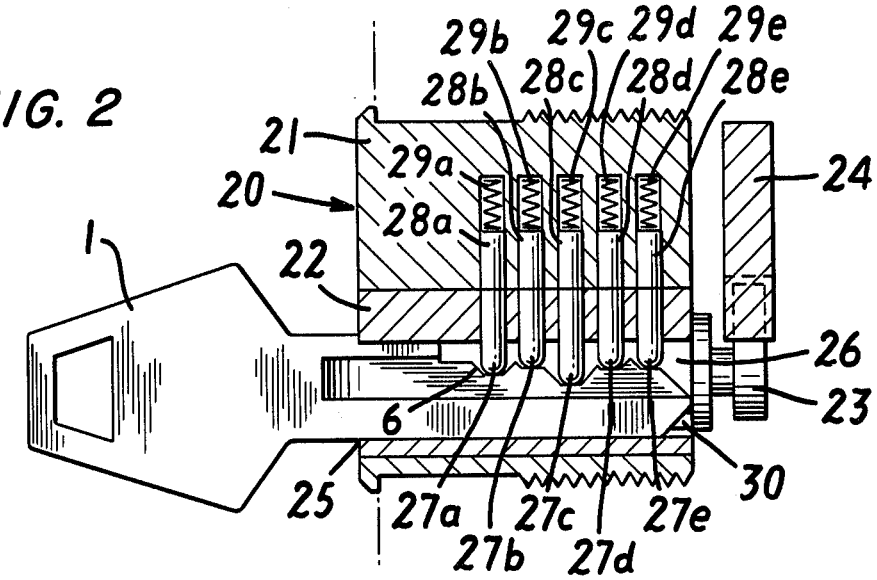
FIG. 2 is a cross-sectional view of the standard size exterior door lock with a key inserted.

Referring to the drawings, a lock system embodying the present invention is shown comprising a key member 1, a first lock mechanism 20, and a second lock mechanism 40, the second lock mechanism 40 being substantially smaller in size and shorter in barrel depth than the first lock mechanism 20.

Figure 1:
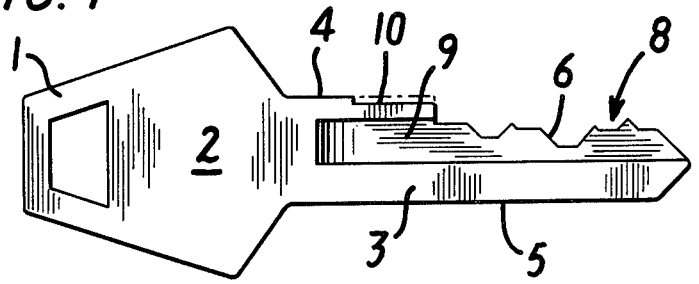
FIG. 1 is a side elevation of a typical key formed according to the present invention.

As seen in FIG. 1, the key is formed in the conventional manner with a handle portion 2 and a shank portion 3 having longitudinal edges 4 and 5. The shank 3 has sufficient length so that longitudinal edges 4 and 5 will permit normal operation of lock mechanisms 20 and 40. The key is formed with a set of notches and projections 6 partially extending along one longitudinal edge 4 on the shank 3 at its outer extremity 8 a distance from the end of the shank 3 approximately equal to the barrel depth of the smaller lock mechanism 40 for cooperation therewith. The key may also be formed with longitudinal grooves 9 on either side of the shank 3 (shown on one side side) to assist in aligning the key in the locks. As illustrated by the dotted line of FIG. 1, key 1 is formed with a notch 10 along a portion of the longitudinal edge 4 lying inward of the notches and projections 6, and the standard size lock 20 is formed to cooperate therewith, as described further below. In another embodiment, a key 11 may be formed with notches and projections 12 along substantially the entire longitudinal edge 13 of the shank 14. Key 11 is otherwise similar to key 1.

As seen in FIG. 2, the first lock mechanism 20 is comprised of an outer cylinder 21 and a rotating inner cylinder commonly referred to as the cylinder plug 22. The cylinder plug 22 rotates a lug 23 which actuates the lock bolt 24. The cylinder plug 22 has a key slot 25 which permits insertion of the key 1 into the barrel 26. A series of tumblers comprising pins 27*a–e* and corresponding plungers 28*a–e* traverse the outer cylinder 21 and cylinder plug 22 and are normally urged downward by corresponding springs 29*a–e* into the barrel 26 of the cylinder plug 22.

Figure 3:
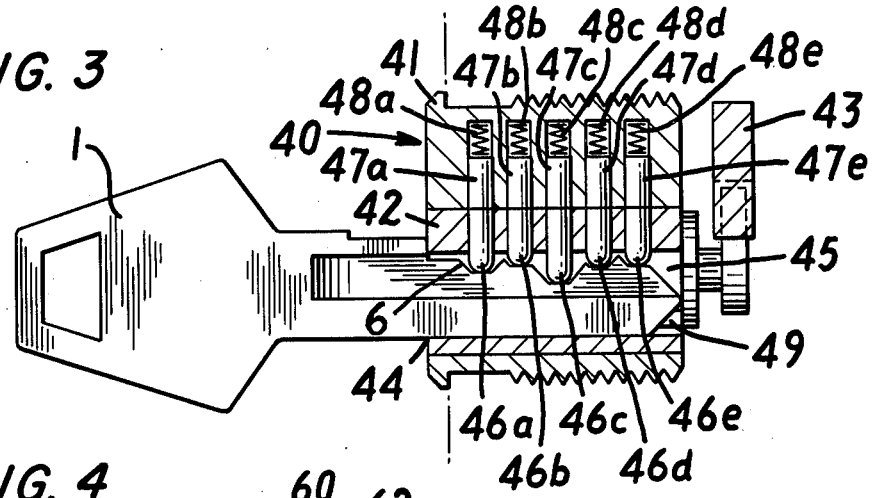
FIG. 3 is a cross-sectional view of a mail receptacle lock with a key inserted.

The lock mechanism 40 likewise has an outer cylinder 41 and a cylinder plug 42 disposed therein where rotation of the cylinder plug 42 operates the lock bolt 43 in substantially the same manner as in lock mechanism 20. Accordingly, the lock mechanism 40 is provided with a key slot 44 which permits insertion of the key 1 or 11 into the barrel 45. A series of tumblers comprising pins 46*a–e* and corresponding plungers 47*a–e* which transverse the outer cylinder 41 and cylinder plug 42 and are normally urged downward into the barrel 45 of the cylinder plug 42 by a series of springs 48*a–e*. The tumblers of lock 20 are spaced apart from each other identically with the spacing of corresponding tumblers of lock 40, and the tumblers of locks 20 and 40 are disposed within their respective lock barrels 26 and 45 such that each corresponding tumbler engages identical portions of the notches and projections 6 of key 1 when the key is inserted in the respective lock. As can be seen by comparing FIGS. 2 and 3, the lengths (settings) of corresponding tumblers in locks 20 and 40, for example, pins 27*a* and 47*a*, may not be identical since the cylinder plugs, 22 and 42, may have a different diameters. The relative lengths of the pins 27*a–e* with respect to each other will, however, be the same as corresponding pins 46*a–e* relative to each other, since corresponding pins engage the same portions of the notches and projections 6. The key barrels 26 and 45 of the lock mechanism, 20 and 40, respectively, are each formed with a pair of longitudinal ribs, 30 and 49, respectively, (one rib shown) corresponding to the longitudinal grooves 9 of the key 1, such that upon insertion of the key 1 into either lock 30 or lock 40 the notches and projections 6 will effectively engage the lock pins 27*a–e* or 46*a–e*, respectively.

Figure 4:
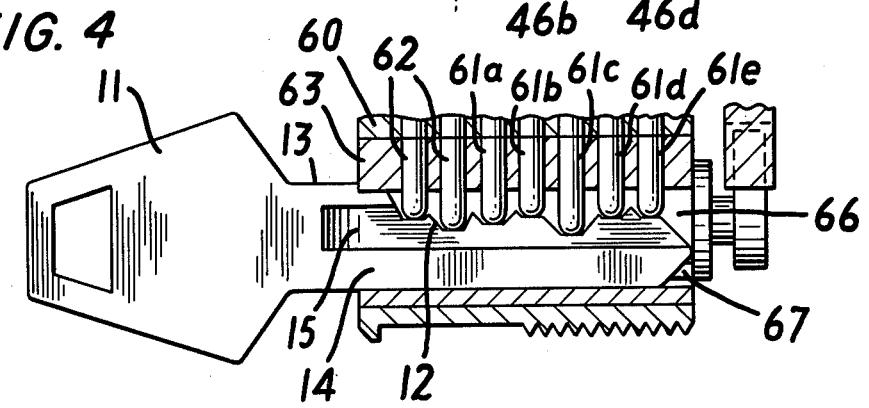
FIG. 4 is a cross-sectional view of an alternative standard size exterior door lock with a corresponding key formed according to the present invention inserted.

Lock mechanism 60, illustrated in FIG. 4, is substantially similar to lock mechanism 20, and has a series of tumblers 61*a–e* comprising pins, plungers and springs (not shown), the tumblers spaced apart and disposed within the lock barrel 66 identically as are the tumblers of lock 20. Lock 60 also has additional tumblers 62 which engage the extended portion of the notches and projections 12 on key 11.

In operation, the lock mechanism 20 is secured in the exterior door of a housing unit and the lock 40 is attached to the door of the mailbox assigned to the same housing unit. When the key 1 is inserted through the slot 25 into the barrel 26 of the lock 20, the notches and projections 6 engage the lock pins 27*a–e* forcing the lock pins 27*a–e* and thereby the corresponding plungers 28*a–e* outwardly in a predetermined fashion. The notches and projections 6 displace the pins and plungers through a predetermined distance so that the cylinder plug 22 of the lock 20 will rotate freely upon corresponding rotation of the key. The longitudinal grooves 9 of key 1 assure that the key will be accurately aligned when inserted in the barrel 26. Upon removal of the key 1, the springs 29*a–e* force the pins 27*a–e* and plungers 28*a–e* downwardly thus rendering the lock inoperable.

Similarly, the mailbox lock 40 is operated by inserting the key 1 through the slot 44 into the barrel 45, thereby engaging pins 46*a–e*. The notches and projections 6 force the pins 46*a–e* and plungers outwardly a distance allowing the cylinder plug 42 to rotate freely with rotation of the key 1, thus operating the lock bolt 43. Upon removal of the key, the springs 48*a–e* urge the plunger downward into the cylinder, thus rendering the lock inoperable.

Figure 5:
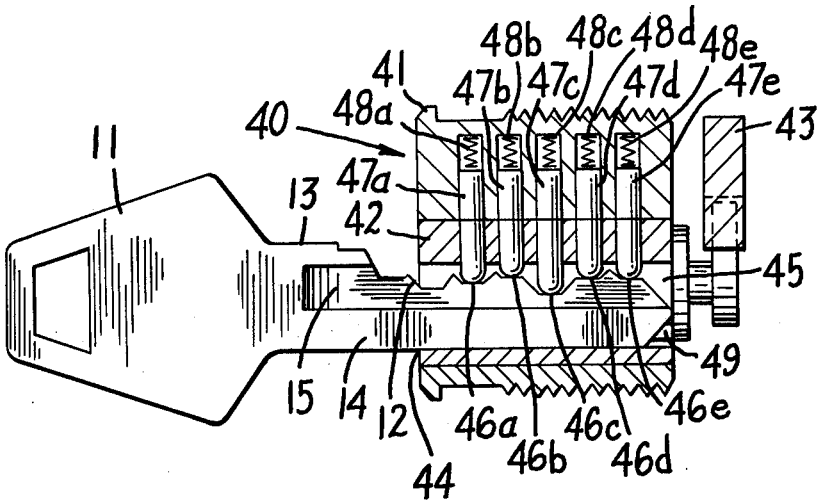
FIG. 5 is a cross-sectional view of the key of FIG. 4 inserted in the mail receptacle lock of FIG. 3.

The operation of the key and lock system including key 11, corresponding lock 60, and lock 40, is similar to that described in connection with key 1. As shown in FIG. 5, when key 11 is inserted into lock 40, a portion of the shank 14 projects into the barrel 45 as determined by the depth of the barrel 45. The portion of the notches and projections 12 thereby disposed within the lock mechanism 40 will engage pins 46*a–e* to force the pins 45*a–e* and corresponding plungers 47*a–e* outwardly a predetermined distance such that the key 11 and cylinder plug 42 may be rotated.

When the key 11 is inserted in lock 60, the notches and projections 12 engage tumblers 61*a–e* to force the tumblers 61*a–e* outwardly, and in addition engage tumblers 62 to force them outwardly a predetermined distance such that the key 11 and cylinder plug 63 may be rotated. Key 11 is aligned within the locks 60 and 40 in a manner similar to key 1, namely, by one or more longitudinal ribs 67 formed within the lock barrel 66 or ribs 49 formed within lock barrel 45 engaging corresponding grooves 15 formed in the flat surfaces of the key shank 14.

The key and lock systems disclosed above offer the advantage that, in addition to a normal key operating both locks, a limited purpose key may be made which will operate only the smaller lock. In the key lock system described in connection with key 11, a limited purpose key would be formed with notches and projections extending along only a portion of the longitudinal edge 13, that is, the limited purpose key would be formed similar to key 1. Thus, the key will retain a sufficient portion of the notches and projections 12 to engage the pins 46*a–e* of lock 40 and will effectively operate that lock, but will not operate lock 60.

A limited purpose key may also be provided with the key lock system described in connection with key 1. Where such is desired, the normal key is provided with a notch 10, and the lock 20 formed with a key slot 25 and barrel 26 corresponding thereto. A limited purpose key may be provided by omitting the notch 10. Engagement of the key slot 25 with the surface area within the dotted line of FIG. 1 would therefore prevent that key from being fully inserted into the barrel 26. The presence or absence of the notch 10 will not, however, affect the operation of key 1 with lock 40, since that portion of the shank 3 remains outside of the lock 40 during operation.

The embodiment of the invention described herein is merely illustrative and the invention may be embodied in other forms while still employing the inventive principles contained herein. Thus, the key-lock system according to the invention could be used to provide a single key for a car trunk, ignition, and doors using different locks, and for different locks to a boat ignition and cabin door and the like.

All such modifications and variations are intended to be within the scope of the invention as defined in the following claims.

We claim:

1. A lock system comprising a combination of (1) a first pin-tumbler lock having an outer cylinder and a rotating cylinder plug, the cylinder plug having a key slot and barrel, and tumblers comprising lock pins and corresponding plungers traversing the outer cylinder and cylinder plug, wherein the lock pins project into the barrel; (2) a second pin-tumbler lock, substantially shorter than the first lock, having an outer cylinder and a rotating cylinder plug, the cylinder plug having a key slot and barrel, and tumblers comprising lock pins and corresponding plungers traversing the outer cylinder and cylinder plug, wherein the lock pins project into the barrel, and (3) a key having a conventional handle portion and shank portion with a series of notches and projections extending along one longitudinal edge of the shank portion which engage the tumbler pins of the first pin-tumbler lock upon insertion of the key so as to render the lock operable, and which engage the tumbler pins of the second pin-tumbler lock upon insertion of the key to render the second lock operable.

2. A lock system according to claim 1, wherein the first pin-tumbler lock is a standard apartment size lock mechanism, and the second lock is a five pin-tumbler standard mailbox lock.

3. A lock system according to claim 2, wherein the first pin-tumbler lock has five tumblers correspondingly spaced apart with those of the second lock and wherein the tumblers of the first lock are disposed within the lock cylinder to engage the identical surfaces of the notches and projections of the key as the corresponding tumblers in the second lock.

4. A lock system according to claim 3, wherein the first pin-tumbler lock has one or more additional tumblers.

5. A lock system according to claim 1, wherein the first lock has tumblers corresponding with and equally spaced apart with respect to the tumblers of the second lock and disposed within the lock cylinder to engage corresponding surfaces of the notches and projections.

6. A lock system according to claim 1, wherein the first lock and the second lock have an equal number of correspondingly spaced apart tumblers, and wherein the tumblers of the first lock are disposed within the lock cylinder to engage the identical surfaces of the notches and projections of the key as the corresponding tumblers in the second lock.

7. A lock system according to claim 1, wherein the cylinder plug of said second lock is smaller in cross-sectional size than the cylinder plug of said first lock.

8. A lock system comprising a combination of (1) a first pin-tumbler lock having an outer cylinder and a rotating cylinder plug, the cylinder plug having a key slot and barrel, and tumblers comprising lock pins and corresponding plungers traversing the outer cylinder and cylinder plug, wherein the lock pins project into the barrel; (2) a second pin-tumbler lock having an outer cylinder and a rotating cylinder plug, said cylinder plug smaller in cross-sectional size than the cylinder plug of said first lock and having a key slot and barrel, and tumblers comprising lock pins and corresponding plungers traversing the outer cylinder and cylinder plug, wherein the lock pins project into the barrel, and (3) a key having a conventional handle portion and shank portion with a series of notches and projections extending along one longitudinal edge of the shank portion which engage the tumbler pins of the first pin-tumbler lock upon insertion of the key so as to render the lock operable, and which engage the tumbler pins of the second pin-tumbler lock upon insertion of the key to render the second lock operable.

9. A lock system according to claim 8, wherein the cylinder plug of said second lock is at least 10% smaller in cross-sectional size than the cylinder plug of said first lock.

10. A lock system according to claim 9, wherein the outer cylinder of said second lock is substantially smaller in cross-sectional size than the outer cylinder of said first lock.

11. A lock system according to claim 9 or 10, wherein said second lock is substantially shorter than said first lock.

* * * * *